US005295856A

United States Patent [19]

Endo et al.

[11] Patent Number: 5,295,856

[45] Date of Patent: Mar. 22, 1994

[54] MULTI-TERMINAL CONNECTOR

[75] Inventors: Takayoshi Endo; Sakai Yagi; Tamio Watanabe, all of Shizuoka, Japan

[73] Assignee: Yazaki Corporation, Tokyo, Japan

[21] Appl. No.: 2,026

[22] Filed: Jan. 8, 1993

[30] Foreign Application Priority Data

Jan. 16, 1992 [JP] Japan ..... 4-005611

[51] Int. Cl.[5] ..... H01R 13/627

[52] U.S. Cl. ..... 439/364; 439/924

[58] Field of Search ..... 403/12, 13, 22; 411/916; 439/359, 360, 361, 362, 363, 364, 924

[56] References Cited

U.S. PATENT DOCUMENTS 4,614,877 9/1986 Knesewitsch et al. ..... 439/924 X
4,952,166 8/1990 Nagasaka et al. ..... 439/364

FOREIGN PATENT DOCUMENTS 62-160471 10/1987 Japan .
7701361 8/1977 Netherlands ..... 439/924
0265211 3/1970 U.S.S.R. ..... 439/924

*Primary Examiner*—Gary F. Paumen
*Assistant Examiner*—Khiem Nguyen
*Attorney, Agent, or Firm*—Sughrue, Mion, Zinn, Macpeak & Seas

[57] ABSTRACT

An improved multi-terminal connector for connecting wire harnesses in automobiles, for example. The connector includes a first connector housing having a plurality of terminal receiving chambers arranged in a transverse direction and a plurality of first metal terminals received in respective terminal receiving chambers, a second connector housing adapted to be mated with the first connector housing and having a plurality of second metal terminals adapted to be electrically connected to respective first metal terminals and connecting force applying and receiving members respectively provided in the first and second connector housings at central portions for mating the first connector housing with the second connector housing and electrically connecting the first metal terminals to the second metal terminals. According to the invention, the terminal receiving chambers gradually project forwardly so that one of the first metal terminals is displaced to slightly project forward in comparison with an adjacent one of the first metal terminals which is located closer to the central portion of the first connector housing in the transverse direction.

6 Claims, 3 Drawing Sheets

MULTI-TERMINAL CONNECTOR

BACKGROUND OF THE INVENTION

1. Field of the Invention

The present invention relates to a multi-terminal connector which is used, for instance, for connecting wire harnesses in an automotive vehicle.

2. Background

Japanese Utility Model Unexamined Publication No. Sho. 62-160471 discloses a conventional multi-terminal connector including a female connector housing made of reinforced synthetic resins and a male connector housing made of normal (not reinforced) synthetic resins.

The female connector housing extends in a transverse direction so as to have a relatively large width. A nut is embedded in a central, reinforced portion of the female connector housing within a surrounding wall. A large number of male metal terminals are pressure-inserted into respective through-holes formed in a main plate portion to be fixedly held on the female connector housing.

On the other hand, a large number of terminal receiving chambers are transversely arranged in the male connector housing in parallel relation to each other. Female metal terminals, each connected to an electric wire prior to insertion, are inserted into the terminal receiving chambers and respectively retained therein by well-known terminal retaining pieces (not shown). A tightening bolt is rotatably supported by a central, reinforced portion of the male connector housing. Male and female connector housings are connected together by threadingly engaging the tightening bolt with the nut.

In the connector thus constructed, the threading engagement between the tightening bolt and the nut allows for sufficient connection at the central portions of the connector housings. However, the non-reinforced male connector housing is inevitably bent or flexured about the central portion, so that a gap is formed, the size of the gap progressively increasing along the width direction from the central portion to the right and left sides of the male connector housing. As a result, the electrical connection between the male and female metal terminals, particularly at the right and left sides, is insufficient.

SUMMARY OF THE INVENTION

The present invention was made in order to solve the above-noted problem of the conventional connector. Accordingly, it is an object of the present invention to provide an improved arrangement for a connector, which assures complete electric connection between mating metal terminals along the entire width of the connector.

In order to attain the above-noted and other objects, the present invention provides a multi-terminal connector extending in a transverse direction, which includes: a first connector housing having a plurality of terminal receiving chambers arranged in parallel relation to each other in the transverse direction and a plurality of first metal terminals received in respective terminal receiving chambers; a second connector housing adapted to be mated with the first connector housing, the second connector housing having a plurality of second metal terminals adapted to be electrically connected to respective first metal terminals; and connecting force applying and receiving members respectively provided in the first and second connector housings at central portions with respect to the transverse direction for mating the first connector housing with the second connector housing and electrically connecting the first metal terminals to the second metal terminals. According to the invention, the terminal receiving chambers, located from the central portion of the first connector housing to lateral sides thereof, gradually project forwardly so that each of the first metal terminals is displaced to slightly project forwardly in comparison with an adjacent first metal terminal which is located closer to, rather than further from, the central portion of the first connector housing in the transverse direction.

During mating connection of the pair of connectors, terminals located at lateral sides thereof are first completely connected to each other. By further driving the connection force applying member, the complete connection of the terminals gradually progresses from the lateral sides toward the central portion.

DETAILED DESCRIPTION OF THE PREFERRED EMBODIMENT

A preferred embodiment of the present invention will now be described in detail with reference to the drawings attached herewith.

Figure 1:
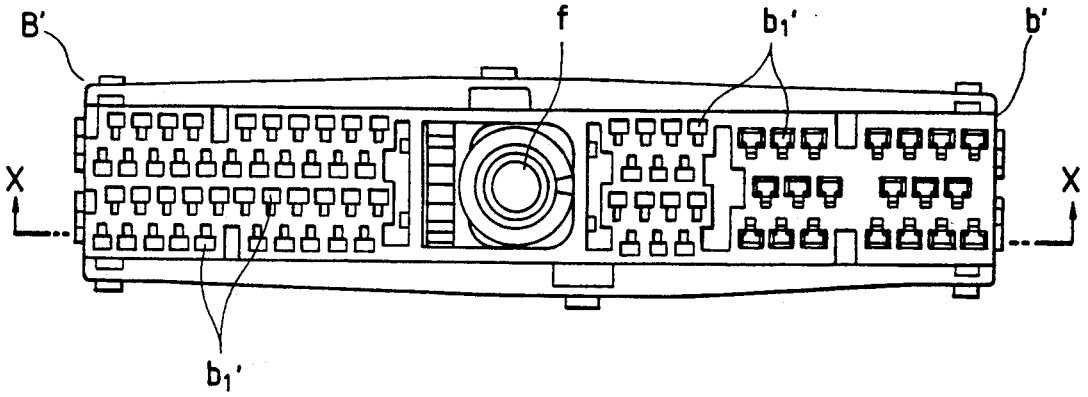
FIG. 1 is a front view showing a male connector of a multi-terminal connector according to an embodiment of the present invention.
Figure 2:
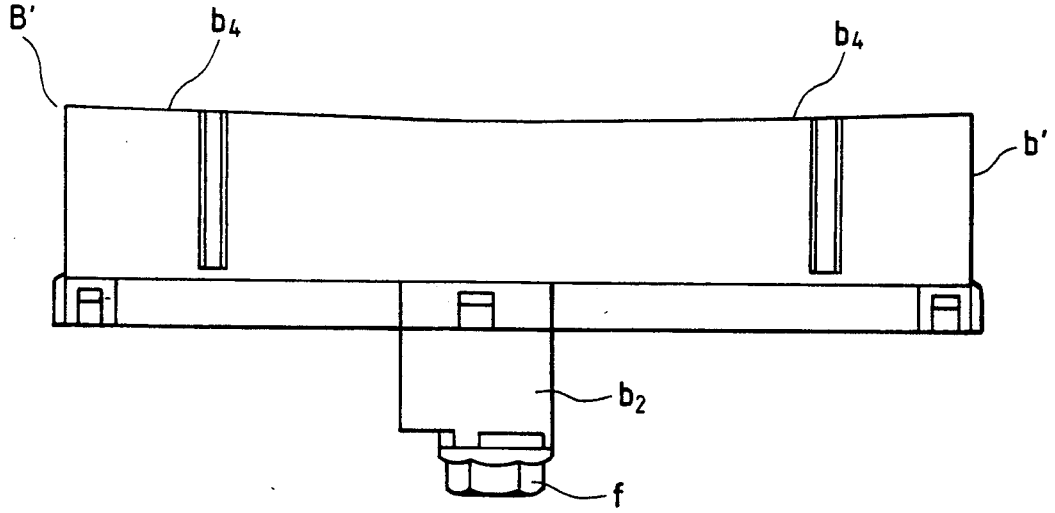
FIG. 2 is a plan view showing the male connector.
Figure 3:
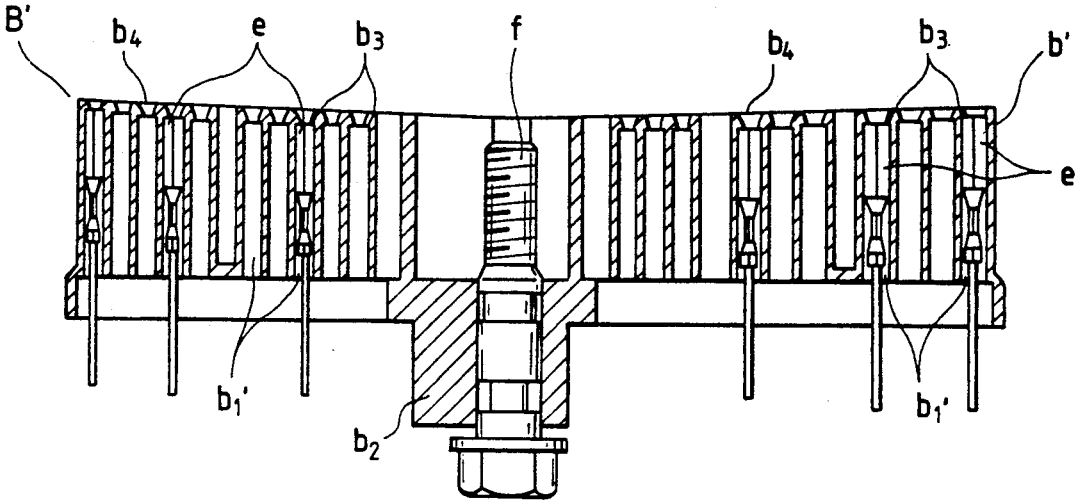
FIG. 3 is a cross-sectional view taken along line 3—3 in FIG. 1.

FIGS. 1 through 3 show a male connector B' of a multi-terminal connector according to an embodiment of the present invention. The entire construction of the male connector B' is substantially the same as that of the conventional male connector B, but different from the latter in the following respect.

A plurality of terminal receiving chambers $b_1'$ are arranged parallel to another in the male connector housing b'. According to the invention, stopper portions $b_3$ at front ends of the terminal receiving chambers $b_1'$ are arranged so as to be gradually displaced forwardly. That is, the amount of forward displacement of the stopper portions $b_3$ is gradually increased along the width of the male connector housing b' from the central portion thereof toward right and left sides thereof, as best shown in FIG. 3. Attendantly, as shown in FIG. 3, a front end $b_4$ of the male connector B' is slightly inclined from the central portion to the right or left sides of the connector B'. Therefore, the female metal terminals e received and retained in respective terminal receiving chambers $b_1'$ are arranged such that a metal terminal slightly projects forward in comparison with an adjacent metal terminal which is located closer to, as opposed to further from, the central portion of the connector B'.

Figure 4:
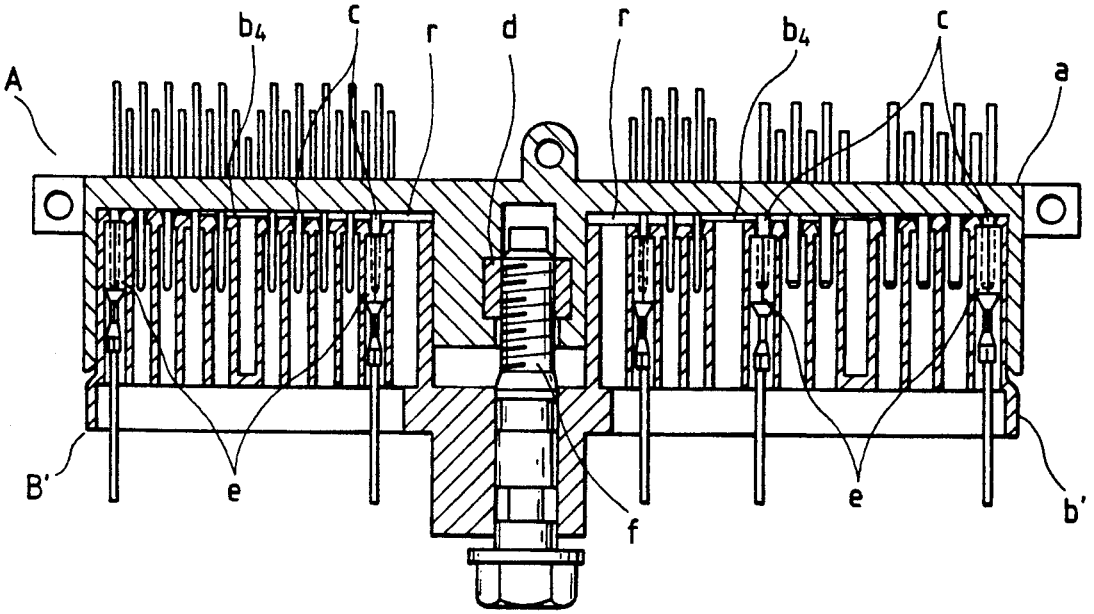
FIG. 4 is a cross-sectional view showing the multi-terminal connector in which the male connector is connected to a female connector.
Figure 5:
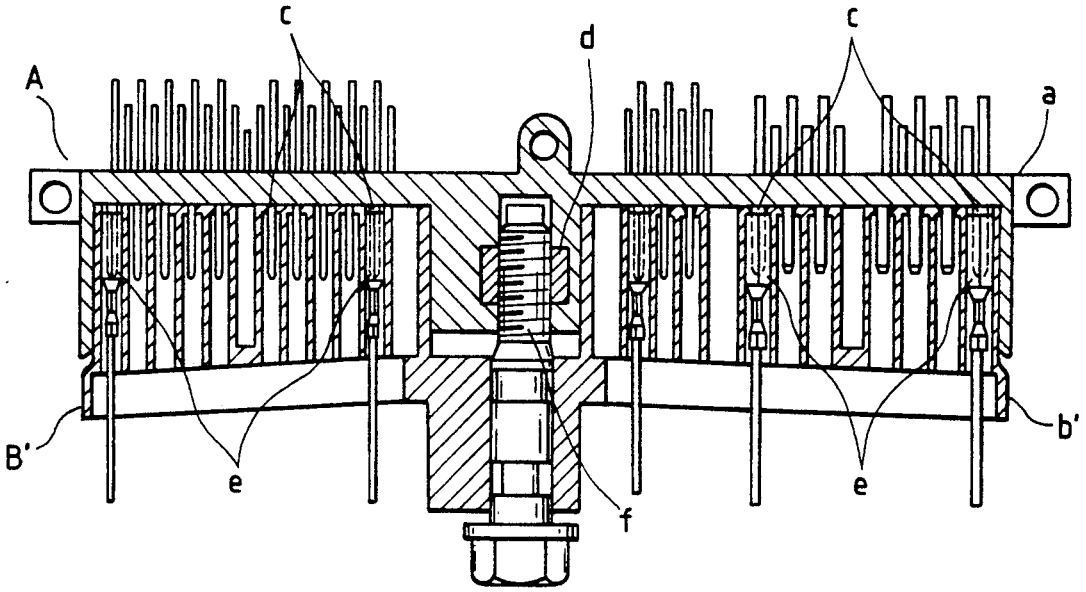
FIG. 5 is a cross-sectional view showing the multi-terminal connector in which the male connector is completely connected to the female connector.

With this construction according to the present invention, when the tightening bolt f, which serves as a connecting force applying member, is tightened while threadingly engaging with the nut d, serving as a connecting force receiving member, the female connector housing a and the male connector housing b' are initially completely connected together at the right and left sides with a gap r remaining at the central portions, as shown in FIG. 4. By further tightening the bolt f to the nut d, the male connector housing b, made of synthetic resin and being flexible, is deformed so that the male and female connector housings a and b' are completely connected together along the entire width without any gap r at the central portions thereof. As a result, the complete electric connection of all mating male and female terminals c and e can be accomplished, as shown in FIG. 5.

In addition, in the embodiment described above, a tightening bolt and a nut are used as the connecting force applying member and the connecting force receiving member, respectively. The present invention should not be restricted thereto or thereby. For example, a cam mechanism or a lever mechanism may be used as the connecting force applying and receiving members.

In a preferred embodiment of the present invention, a multi-terminal connector includes one connector housing extending in a transverse direction and being provided with a plurality of terminal receiving chambers arranged parallel to each other in the transverse direction, and the other connector housing being provided with terminals which corresponds to terminals received in the terminal receiving chambers. A connecting force applying member is provided on the one connector housing at its central portion, and, on the other hand, a connecting force receiving member is provided in the other connector housing at its central portion. The terminal receiving chambers in the one connector housing are arranged to gradually project forwardly in accordance with their transverse positions from the central portion toward the right and left sides of the one housing. Further, the metal terminals received in the respective terminal receiving chambers are also located to gradually project forwardly. Therefore, the multi-terminal connector according to the present invention can provide the complete and stable electrical connection of the mating terminals over the entire width thereof even if the connecting force applying and receiving members are provided at the central portion of the transversely extending multi-terminal connector.

What is claimed is:

1. A multi-terminal connector extending in a traverse direction, comprising:

a first connector housing having a plurality of terminal receiving chambers arranged in parallel relation to each other in the transverse direction and a plurality of first metal terminals received in respective terminal receiving chambers;

a second connector housing adapted to be mated with said first connector housing, said second connector housing having a plurality of second metal terminals adapted to be electrically connected to respective first metal terminals; and connecting means, provided in said first and second connector housings at central portions thereof with respect to said transverse direction, for mating said first connector housing with said second connector housing and respectively electrically connecting said first metal terminals to said second metal terminals, wherein said terminal receiving chambers, being located from the central portion of said first connector housing toward lateral sides thereof, gradually project forwardly toward said second connector housing in a sloped manner from the central portion so that a first metal terminal is disposed forwardly of an adjacent first metal terminal which is located closer to the central portion of said first connector housing in the transverse direction.

2. The connector of claim 1, wherein each of said first metal terminals having an adjacent first metal terminal disposed closer to said central portion is disposed forwardly of said adjacent first metal terminal.

3. The connector of claim 2, wherein said first connector housing includes a front end which is sloped from the central portion to said lateral sides so that said front end contacts said second connector housing at said lateral sides with a gap remaining between said first and second connector housing at the central portion.

4. The connector of claim 2, wherein said connecting means comprises connecting force applying and receiving members respectively provided in said first and second connector housings.

5. The connector of claim 4, wherein said connecting force applying member includes a screw and said connecting force receiving member includes a nut.

6. The connector of claim 5, wherein said nut is embedded in said second connector housing.

* * * * *